US007448091B2

(12) United States Patent
Kruss

(10) Patent No.: US 7,448,091 B2
(45) Date of Patent: Nov. 11, 2008

(54) WATERTIGHT PROTECTIVE ELASTOMERIC GLOVES

(75) Inventor: Sergey Kruss, Millis, MA (US)

(73) Assignee: Applicont, LLC, Millis, MA (US)

( * ) Notice: Subject to any disclaimer, the term of this patent is extended or adjusted under 35 U.S.C. 154(b) by 652 days.

(21) Appl. No.: 10/452,406

(22) Filed: Jun. 2, 2003

(65) Prior Publication Data

US 2004/0092852 A1 May 13, 2004

Related U.S. Application Data

(60) Provisional application No. 60/424,438, filed on Nov. 7, 2002.

(51) Int. Cl.
*A41D 19/00* (2006.01)

(52) U.S. Cl. ..... 2/161.7

(58) Field of Classification Search ..... 2/16, 2/20, 158, 161.7; 128/878, 879; 602/21, 602/3

See application file for complete search history.

(56) References Cited

U.S. PATENT DOCUMENTS 1,097,018 A * 5/1914 Hadfield ..... 2/168
2,244,871 A 6/1941 Guinzburg
2,335,871 A * 12/1943 Milligan ..... 2/168
3,197,786 A * 8/1965 Velonis et al. ..... 2/167
3,867,727 A * 2/1975 Povlacs ..... 2/167
4,346,699 A * 8/1982 Little et al. ..... 602/3
4,441,213 A * 4/1984 Trumble et al. ..... 2/16
4,562,834 A 1/1986 Bates et al.
4,809,365 A * 3/1989 Chen et al. ..... 2/168
4,845,780 A 7/1989 Reimers et al.
4,884,300 A 12/1989 Vistins
4,911,151 A 3/1990 Rankin et al.
4,966,135 A * 10/1990 Renfrew ..... 602/3
5,063,919 A * 11/1991 Silverberg ..... 602/3
5,188,608 A * 2/1993 Fritts ..... 604/179
5,336,204 A 8/1994 Matyas
5,395,302 A 3/1995 Botha et al.

(Continued)

OTHER PUBLICATIONS

Wikipedia Internet reference of synthetic polymers.*

*Primary Examiner*—Katherine Moran
(74) *Attorney, Agent, or Firm*—Devine Millimet & Branch Pa; Raymond I. Bruttomesso, Jr.; Paul C. Remus

(57) ABSTRACT

Presented are several embodiments of a disposable elastomeric glove for protecting IV-catheters in human hands and forearms against water and water borne infection. Said protective glove (also called "IV-Glove") comprises a resilient cylindrical or conical cuff snuggly embracing a human forearm thereby creating a watertight seal, which shields water from getting inside said glove during washing and showering. IV-Glove is made substantially loose around possible IV-catheter insertion sites, providing space large enough to accommodate IV-catheters along with infusion plugs and means of affixing said plugs and catheters to skin. IV-Glove may be manufactured in variety of types, of which some are intended to protect IV-sites in backs of human hands, whereas other types are more suited to protect IV-sites in human forearms. IV-Glove for a hand has increased body size bulging over a back of a hand. The glove intended for waterproofing IV-lines in forearms has a long sleeve connecting a glove body with a watertight cuff. Said sleeve is made substantially loose around a forearm, thereby accommodating an IV-site. A multipurpose version comprising a long sleeve and a bubble-like body, whereby suited for IV-lines anywhere in a hand and a forearm, is also proposed herein.

9 Claims, 2 Drawing Sheets

U.S. PATENT DOCUMENTS 5,575,014 A * 11/1996 Kane et al. ..... 2/239
5,592,953 A 1/1997 Delao
5,605,534 A 2/1997 Hutchison
5,643,183 A 7/1997 Hill
5,720,713 A * 2/1998 Hutchison ..... 602/3
5,728,052 A 3/1998 Meehan
5,734,992 A * 4/1998 Ross ..... 2/161.7
5,761,746 A 6/1998 Brown
5,907,870 A * 6/1999 Monroe et al. ..... 2/161.7
6,053,170 A * 4/2000 Padilla, Jr. ..... 128/877
6,210,352 B1 4/2001 Williams et al.
6,276,364 B1 * 8/2001 Warner ..... 128/846
6,526,981 B1 * 3/2003 Rozier et al. ..... 128/846
2004/0127827 A1 * 7/2004 Fancher ..... 602/41

* cited by examiner

WATERTIGHT PROTECTIVE ELASTOMERIC GLOVES

CROSS-REFERENCE TO RELATED APPLICATION

This application claims the benefit of Provisional Patent Application No. 60/424,438, filed Nov. 7, 2002, titled "Water Tight Protective Elastomeric Gloves".

FEDERALLY SPONSORED RESEARCH

Not applicable

MICROFICHE APPENDIX

Not applicable

BACKGROUND OF THE INVENTION

1. Field of Invention

This invention relates to disposable single use elastomeric gloves for protection of infusion devices inserted in human hands and arms against water. The purpose of said gloves is to keep said hands and arms dry while patients wash or take baths or showers.

2. Description of Prior Art

The idea of protecting a human limb against water has been around for a long time, and a plurality of contraptions serving this purpose have been invented. The common goal of all such devices is to alleviate a process of washing for patients, who for any reasons should keep their limbs dry. Most noticeably such necessity might occur when a person has a bandage or a cast over an injury or when an intravenous infusion device is inserted in a person's limb.

The majority of such devices present various sheaths and sleeves, which can be pulled on human limbs and closed tightly or sealed around said limbs at open ends. However quite different ideas has also been patented, among which the most notable is one described in U.S. Pat. No. 5,336,204. This invention suggests that the IV-insertion site be covered locally by a rigid plastic cap, providing both protection against water and accidental dislodging. With all its ingenuity, however, this contraption appears to be labor intensive in installation and too expensive to serve as a disposable single use article.

Plastic (PVC, polyethylene, etc.) sheaths and sleeves with sealing means, comprising fasteners, bandages, sealant layers and straps, are plentiful and some of such devices have found their way to the present U.S. market. U.S. Pat. Nos. 4,911,151; 4,562,834; 5,605,534; 5,643,183; 6,210,352; 5,720,713; 5,395,302; 5,592,953 present incomplete list of related devices. Among these devices only one, exposed by U.S. Pat. No. 4,911,151, is explicitly defined as disposable. These contraptions, while providing good protection for IV-lines and other sites on human limbs intended to be kept dry, are rather complex in use and overly expensive in production, which prevents them from being commonly used.

The most noteworthy inventions in the field of protection of IV-sites and injuries of human limbs are thin walled elastomeric sheathes and sleeves, which allow very inexpensive production by means of dip molding technology, thereby having the advantage of being single use articles. U.S. Pat. Nos. 5,728,052; 6,276,364; 4,346,699 along with some others constitute this group. The invention of U.S. Pat. No. 6,276,364 is of much interest, as it combines good protection against water with ease of donning and potential disposability. However, this device demands technology, which hitherto has not been well developed, wherefore it cannot be produced in quantities. U.S. Pat. No. 4,346,699 probably deserves the most interest. This invention is simple and inexpensive in production and easy in use. Its only deficiency is the lack of comfort for a patient, for this device does not allow use of fingers, when it is donned on a human hand.

The last group of related inventions, reflected by U.S. Pat. Nos. 4,884,300; 4,845,780, contains elastomeric gloves with means of securing cuffs of said gloves around wrists or arms. These devices, however, cannot be used for keeping dry IV-sites on human hands and arms for the following reasons: (1) the prescribed methods of securing cuffs, while serving the purpose of holding gloves in place, do not provide waterproof seals; (2) gloves in question do not provide any room or space for IV-catheters with infusion plugs and means or securing said catheters; (3) they do not provide for the case when an IV-line is attached to a mid or upper forearm.

The protective gloves proposed herein combine all the advantages of devices existing heretofore, while being free of aforementioned deficiencies. The gloves of this invention (1) render waterproof seals around arms on which they are donned; (2) provide ample space for IV-catheters along with infusion plugs and fixtures; (3) furnish sufficient comfort and ease of use of hands; (4) they are easy to don and strip off without external help; (5) several versions of gloves with overlapping features, proposed herein, jointly offer protection for various cases of IV-catheter insertion—in hands and in forearms; (6) manufacturing of proposed protective gloves employs standard dip molding technology, whereby they are inexpensive to produce and therefore disposable.

BRIEF SUMMARY OF THE INVENTION

The present invention introduces disposable gloves for protecting against water intravenous catheters in human hands and forearms.

Upon hospital admission almost every patient has an intravenous catheter (AKA IV-catheter) inserted in his or her forearm or a back of a hand. Normally an IV-catheter is preserved until the patient gets discharged regardless of whether or not an actual infusion line is connected to an infusion plug of the catheter. This IV-site presents a serious hindrance in the way of washing or showering the patient. Should it get wet in the process it may become a gate for waterborne infection. Untimely replacing the catheter constitutes extra inconvenience for a patient and puts additional workload upon IV nurses, hence increasing health care expenses of hospitals. For obvious reasons situation becomes even more aggravating for home care patients with permanent IV-sites. Protective gloves presented herein are intended to solve this problem.

This invention comprises several types of disposable elastomeric protective gloves which all are characterized by the following features:

1) watertight cuffs at the proximal ends of all gloves;
2) substantially loose fit around insertion sites, sufficient to accommodate catheters with insertion plugs and means of affixing said catheters to skin. The circumferences of the cuffs are less than circumferences of the corresponding parts of forearms encased by said cuffs, thereby said cuffs tightly and snuggly sheath forearms producing watertight seals. Opened proximal ends cuffs are finished with rolled beads.

For protecting a catheter inserted in a back of a hand the IV-catheter protective glove may be produced with a short sleeve and a substantial bubble-like bulge on a back of a hand.

For an IV-line attached to a forearm the glove must be furnished with a long loose sleeve, covering at least most of forearm's length. This sleeve shall fit loosely enough to provide sufficient room between its wall and a forearm in order to accommodate a catheter with its auxiliaries.

Figure 1:
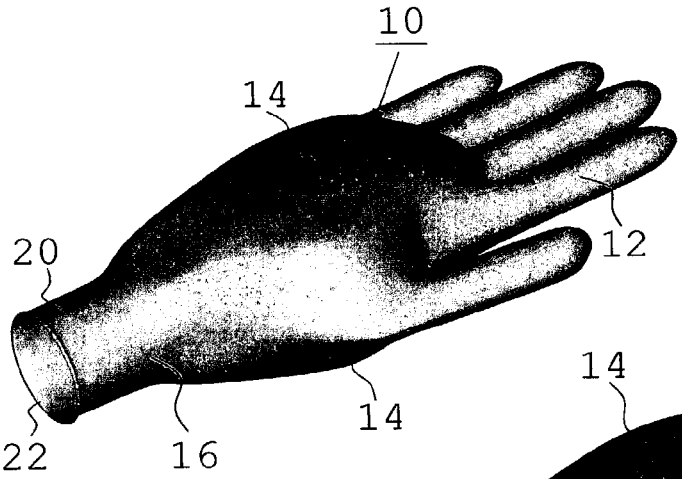
FIG. 1 presents a perspective side view of "Short Glove"—an IV-Glove, intended for waterproofing an IV-line attached to a back of a hand.

REFERENCE NUMERALS IN DRAWINGS 10 body of the glove
12 finger receptacles
14 bubble-like bulge on the main body
16 short sleeve between the body of Short Glove and its tight cuff
18 long loose sleeve between the tight cuff and the body of Long Glove
20 waterproof tight cuff
22 rolled bead

DETAILED DESCRIPTION OF THE INVENTION

While this invention may be satisfied by a plurality of embodiments, the drawings and the description herein elaborate on the details of preferred embodiments of Watertight Protective Elastomeric Gloves (hereinafter IV-Gloves). However the present disclosure must be considered as exemplary of the principles of the present invention and is not intended to limit this invention to the embodiments illustrated.

As it is implied by the name the main purpose of IV-Gloves is to provide watertight shielding of intravenous catheters in human hands and forearm, however their very important auxiliary application is keeping dry and protecting from infection wounds and bandages.

Every type and embodiment of IV-Glove consists of a thin-walled hollow body (10) with 5 finger receptacles (12), a cylindrical or slightly conical cuff (20) and a sleeve (16 and 18) connecting the latter to the former. Depending on the given embodiment, corresponding to the exact intended application of the glove, this sleeve may be as short as would only suffice to constitute a smooth transition from the body of the glove to its cuff (FIG. 1), or it may be long enough to cover the larger part or the whole length of a forearm (FIG. 2A and FIG. 2B). In FIG. 2A, the sleeve is sufficiently long to cover substantially the entire length of the forearm.

The circumference of the cuff is substantially less than of corresponding part of an arm, on which said cuff is donned, wherefore said arm is tightly embraced by the cuff. The proximal end of the cuff, which is an open tubular cuff, may be finished with a rolled bead (22). With the circumference of the cuff substantially less than that of the circumference of the corresponding part of the forearm, the arm is tightly embraced by the cuff to form a watertight seal.

Figure 3:
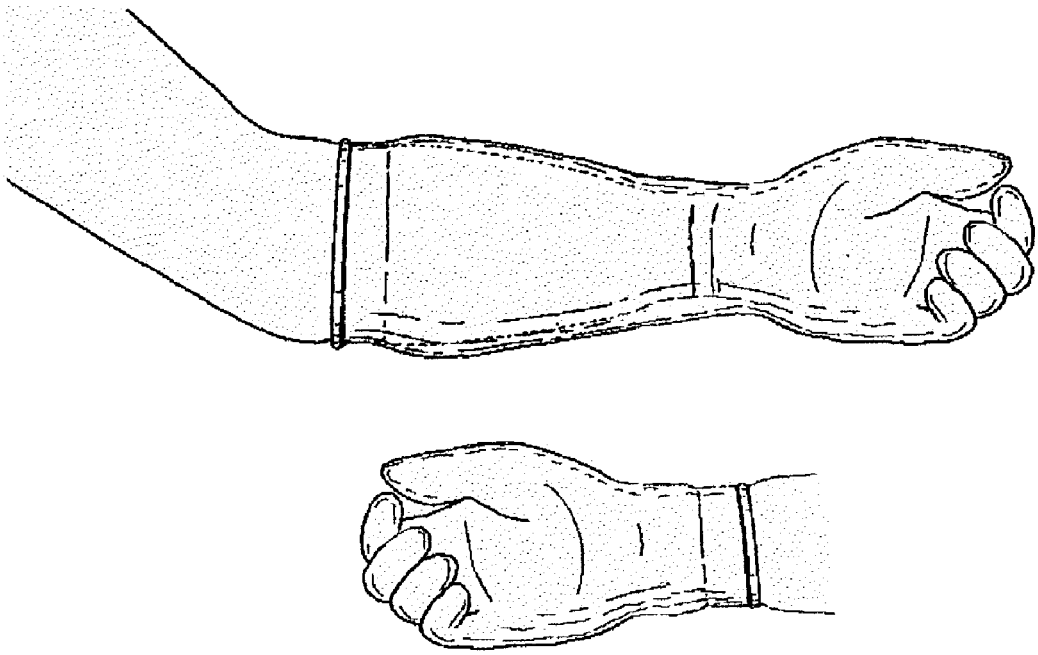
FIG. 3 presents general views of two IV-gloves of different kinds being donned on a an hand and arm. Watertight cuffs are considerably stretched.

IV-Glove shall be produced of elastic and resilient material such as natural rubber latex or synthetic polymer with similar qualities. The gloves, disposable gloves come in varies sizes, so that the glove correlates with size of the hand and forearm of the user. Resilience of material, combined with tight enwrapping of the arm by the cuff, secures a waterproof seal between the cuff and the arm, effectively keeping the hand with the arm inside the glove dry, while the glove is subjected to water. FIG. 3 presents a general views of two kinds of IV-gloves donned on a human hand and an arm. The figure illustrates how the cuffs are considerably stretched during normal usage, thus providing constriction of a forearm.

IV-Glove is made substantially loose around possible IV-catheter insertion sites, providing space, large enough to accommodate IV-catheters along with infusion plugs and means of affixing said plugs and catheters to skin. IV-gloves must conform to the requirements imposed by placing of intravenous lines, which are predominantly connected to either backs of hands or forearms. Types of IV-Gloves vary in shapes according to their intended usage.

Figure 2A:
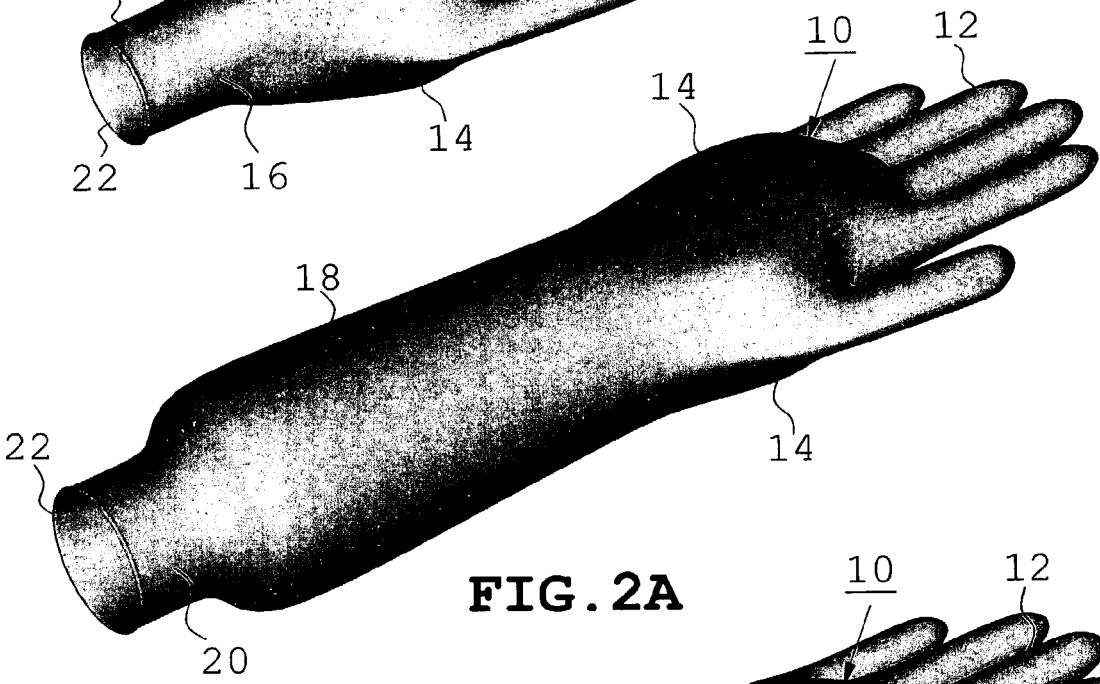
FIG. 2A presents a perspective side view of multipurpose "Long Glove", suited for waterproofing catheters in forearms and hands.
Figure 2B:
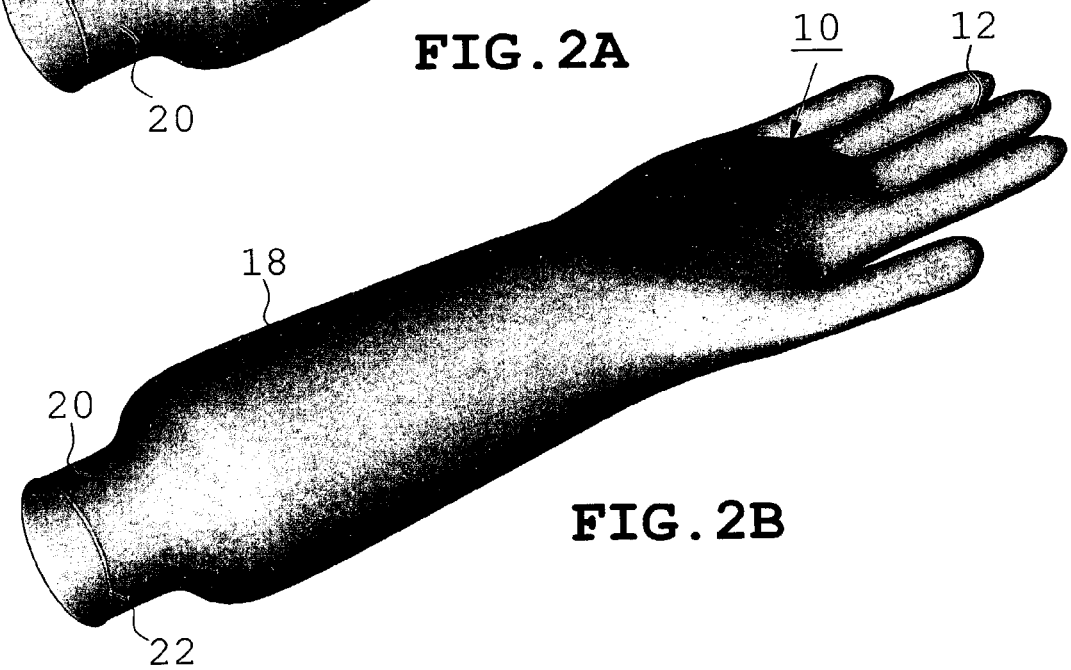
FIG. 2B presents a perspective side view of tightly fitting "Long Glove", intended for protection of IV-catheters in forearms only.

For IV-lines connected to backs of hands the glove shown in FIG. 1 is most suitable. The special feature of this IV-glove is a spacious body (10) with either one bubble-like bulge (14) on the back of the hand or two similar bulges on the back of the hand and on the palm of said hand. For the sake of readability of this text hereinafter all gloves of this kind will be referred to as "Short Gloves". Construction, in which two bulges are placed symmetrically with respect to the plane, connecting axes of all fingers, renders the glove ambidextrous. Short Glove is characterized by fairly short transition (16) between the body and the watertight cuff (20). When only hand protection is needed Short Glove provides maximum comfort for a patient.

In cases of insertion catheters in forearms gloves shown in FIG. 2A and FIG. 2B must be employed. Hereinafter IV-gloves containing long loose sleeves will be referred to as "Long Gloves". Long Glove presented in FIG. 2A comprises a bulging bubble-like main body (10) and a loose spacious sleeve (18) along with a watertight cuff (20) at the proximal end. The circumference of the sleeve (18) is substantially greater than the circumference of the forearm. There is ample space for an IV-catheter with its ancillary equipment or for a bandage within the sleeve as well as within the body of the glove. Such construction is well suited for protecting an IV-site or wound or bandage anywhere on a hand and a forearm. The preferred embodiment of Long glove is ambidextrous with body bulges (14) on the side of a palm and a back of a hand.

Long Glove presented in FIG. 2B differs from the one of FIG. 1A by having a tightly fitting body instead of a spacious bubble-like body. Such organization provides better comfort in using a hand for a patient who needs to shield only his or her forearm. However it lacks the universal properties of the glove of FIG. 2A.

What is claimed is:

1. A protective glove constructed of elastic and resilient elastomer, the glove comprising a hollow body adapted for receiving a human hand therein, the body having a distal end and a proximal end, a plurality of distally closed finger receptacles extending from the body substantially at the distal end each finger receptacle defining a longitudinal axis, a sleeve extending proximally from the proximal end and terminating proximally as an open tubular cuff, wherein the body is symmetrical relative to a plane containing each of the longitudinal axes of the finger receptacles, whereby the protective glove is ambidextrous; the body of the glove having a palm side and a back side, the glove body has two bubble-like bulges, a first one of the two bulges being on one of the sides, a second one of the two bulges being on the other side, thereby the body fits the hand loosely enough to accommodate small objects affixed to the hand, and the cuff having a circumference substantially less than a circumference of a corresponding part of a forearm over which the cuff is drawn while the protective glove is donned on the hand, whereby the cuff tightly embraces the part of the forearm, producing a watertight seal, whereby water and other substances, to which the hand and the arm are subjected, are effectively excluded from the inside of the protective glove.

2. The protective glove of claim 1, wherein the sleeve is sufficiently long to cover at least the larger part of a forearm and the circumference of said sleeve is substantially greater than the circumference of the forearm, whereby the space between a wall of said sleeve and said forearm within said sleeve may accommodate small objects affixed to said forearm.

3. The protective glove of claim 1 wherein the bubble-like bulge is adapted to fit over an intravenous catheter site on a back of a human hand, wherein said catheter site comprises an IV-catheter, inserted in the back of the hand, an infusion plug, attached to said catheter, and means of securing said catheter and said plug in place.

4. The protective glove of claim 2 wherein the sleeve is adapted to fit over an intravenous catheter site anywhere on the human hand or the forearm, wherein said catheter site comprises an IV-catheter, inserted in said forearm, along with an infusion plug attached to said catheter, and means of securing said catheter and said plug in place.

5. A protective glove for receiving a portion of a forearm and a hand, the hand including a plurality of fingers, a thumb, a back of the hand, a palm of the hand, the glove comprising:

a hollow body, the body having a closed distal end and a proximal end;

wherein the body further comprises a palm side and back side and a first bubble-like bulge on the back side and second bubble-like bulge on the palm side, wherein the glove body is symmetrical relative to a plane containing each of the longitudinal axes of the finger receptacles, whereby the glove is ambidextrous and the body fits the hand loosely enough to accomodate a small object affixed to the hand, a plurality of finger receptacles extending from the body at the distal end each finger receptacle defining a longitudinal axis;

a sleeve terminating at the proximal end with an open tubular cuff, wherein the sleeve being of sufficient length to cover substantially the entire length of the forearm and the sleeve interposed between the tubular cuff and the distal finger receptacles having a portion of substantially greater circumference than the circumference of the forearm, thereby defining a space between the body of the glove and the forearm for accommodating a small object affixed to the forearm; and the cuff having a circumference substantially less than the circumference of a corresponding part of the forearm over which the cuff is drawn while the protective glove is donned on the hand, whereby the cuff tightly embraces the forearm, producing a watertight seal, whereby water and other substances, to which the hand and the arm are subjected, are effectively excluded from the inside of the protective glove.

6. The protective glove of claim 5 wherein the sleeve is adapted to fit over an intravenous catheter site anywhere on the hand or the forearm, wherein the catheter site comprises an IV-catheter, inserted in the forearm, an infusion plug attached to the catheter, and means of securing the catheter and the plug in place.

7. A protective glove for receiving a portion of a forearm and a hand, the hand including a plurality of fingers, a thumb, a back of the hand, a palm of the hand, the glove comprising:

a hollow body, the body having a closed distal end and a proximal end the body having a palm side and a back side;

a plurality of finger receptacles extending from the body at the distal end, each finger receptacle defining a longitudinal axis wherein the body of the glove further comprising a pair of bubble-like bulges and the glove symmetrical relative to a plane containing axes of the finger receptacles, whereby the protective glove is ambidextrous and the first of the bulges on the back side and the second bulge on the palm side, thereby the body of the glove fits the hand loosely enough to accommodate a small object affixed to the hand;

a sleeve terminating at the proximal end with an open tubular cuff and the cuff having a circumference substantially less than the circumference of a corresponding part of the forearm over which the cuff is drawn while the protective glove is donned on the hand, whereby the cuff tightly embraces the forearm, producing a watertight seal, whereby water and other substances, to which the hand and the arm are subjected, are effectively excluded from the inside of said protective glove.

8. The protective glove of claim 5, wherein the glove is comprised of an elastic and resilient elastomeric material.

9. The protective glove of claim 8, wherein the sleeve being of sufficient length to cover substantially the entire length of the forearm and the sleeve interposed between the tubular cuff and the distal finger receptacles having a portion of substantially greater circumference than the circumference of the forearm, thereby defining a space between the body of the glove and the forearm for accommodating a small object affixed to said forearm.

* * * * *